US006131778A

United States Patent [19]

Etzion

[11] Patent Number: 6,131,778

[45] Date of Patent: Oct. 17, 2000

[54] BOW MAKER WITH RIBBON SECURING ELEMENT

[76] Inventor: Rafael Etzion, 15 Henhawk Rd., Great Neck, N.Y. 11024

[21] Appl. No.: 09/360,967

[22] Filed: Jul. 27, 1999

[51] Int. Cl.[7] ..... A41D 27/12

[52] U.S. Cl. ..... 223/46; 28/147

[58] Field of Search ..... 223/46, 44; 28/147, 28/148, 149

[56] References Cited

U.S. PATENT DOCUMENTS

| | | | |
|---|---|---|---|
| D. 389,998 | 2/1998 | Cavender et al. | D3/26 |
| 1,010,155 | 11/1911 | Lange . | |
| 1,307,069 | 6/1919 | Weismantel . | |
| 2,077,370 | 4/1937 | Reynolds | 223/46 |
| 2,521,863 | 9/1950 | Mertz | 223/46 |
| 2,569,943 | 10/1951 | Mitchell | 223/46 |
| 2,610,436 | 9/1952 | Hoeycutt | 223/44 |
| 2,666,249 | 1/1954 | Ruiz et al. | 28/2 |
| 2,763,080 | 9/1956 | Welch | 41/10 |
| 2,959,825 | 11/1960 | Gould | 223/44 |
| 3,462,049 | 8/1969 | Smith | 223/46 |
| 3,501,070 | 3/1970 | Shattuck | 223/46 |
| 3,816,888 | 6/1974 | Rather, Jr. | 28/2 |
| 4,410,113 | 10/1983 | Palombo | 223/46 |
| 4,454,968 | 6/1984 | StLawrence | 223/46 |
| 4,629,100 | 12/1986 | Owens | 223/46 |
| 4,714,182 | 12/1987 | Hecht | 223/46 |
| 5,094,370 | 3/1992 | Specht | 223/46 |
| 5,356,056 | 10/1994 | Teuten | 223/46 |
| 5,411,188 | 5/1995 | Teuten | 223/46 |
| 5,617,979 | 4/1997 | Cavender | 223/46 |
| 5,662,250 | 9/1997 | Werling | 223/46 |
| 5,810,214 | 9/1998 | Hecht | 223/46 |

*Primary Examiner*—Bibhu Mohanty
*Attorney, Agent, or Firm*—Robin, Blecker & Daley

[57] ABSTRACT

A bow-making jig includes a circular base having a top surface in which numerous holes are formed, arranged in a number of rows. The holes are shaped and sized to receive pegs around which ribbon may be wound to form bow-loops. A preferred configuration of the bow-making jig includes pegs mounted in the base and each having associated with the respective peg a holding means such as a plastic clip which serves to hold the ribbon loop on the surface of the respective peg. Preferably the clips are pivotally mounted on the respective pegs by means of hinge pins provided on the clips.

18 Claims, 5 Drawing Sheets

BOW MAKER WITH RIBBON SECURING ELEMENT

FIELD OF THE INVENTION

This invention is concerned with a device to be used in making bows out of ribbon, and is more particularly concerned with a device that is intended for use by amateur bow-makers.

BACKGROUND OF THE INVENTION

Jigs for use in fashioning bows out of ribbon are well known. For example, U.S. Pat. No. 5,810,214 (issued to Hecht) discloses a bow-making jig which is said to be intended for novice bow-makers. Hecht's jig includes a substantially rectangular base having a row of circular holes formed in the top surface thereof. The holes are adapted to receive pegs to be mounted on the base in an upright position. At an intermediate point in the row of holes a pair of hoops extends upwardly from the base. In use, a peg is placed in a respective hole on each side of the pair of hoops and a length of ribbon is wound around the pegs to form ribbon loops. The ribbon is passed between the hoops in a position such that the ribbon is held between the pegs by the pair of hoops.

The applicant believes that Hecht's pair of hoops, although intended to aid the user of the jig, would tend to interfere with the movement of the user's hands. In addition, it is believed to be rather difficult to thread the ribbon between the hoops.

U.S. Pat. No. 2,666,249 (issued to Ruiz et al.) discloses a bow-making jig similar to Hecht's, in that Ruiz's jig also includes a row of holes into which pegs may be inserted. Instead of Hecht's pair of hoops, a slotted peg is provided at a central point in Ruiz's row of holes. The slotted peg is intended to constrain the loops of ribbon which are wound around rods on opposite sides of the slotted peg. The disclosure of the Ruiz patent is incorporated herein by reference.

Bow-making jigs provided according to the prior art generally require the user to maintain tension on the ribbon to keep it in place until a fastener is tied around a central part of the bow. While professional bow-makers become quite proficient at maintaining the necessary tension without permitting the ribbon loops to become disarranged, amateurs often find this to be a difficult aspect of the bow-making operation.

Another disadvantage of known bow-making jigs is that a rather limited number of styles and configurations of bows can be made with the prior art jigs.

OBJECTS AND SUMMARY OF THE INVENTION

It is accordingly an object of the invention to provide a bow-making jig which is easier to use than conventional jigs.

It is another object of the invention to provide a bow-making jig which is useful in making a wide variety of different types of bows.

According to an aspect of the invention, there is provided a bow-making apparatus which includes a base, the base having a top surface with a plurality of holes formed in the top surface, each of the holes being shaped and sized to receive a respective peg, and the apparatus also including a plurality of pegs, each mounted in a respective one of the holes and each having a vertically-oriented outer surface, and a holding device, associated with one of the pegs, for holding a ribbon on the vertically-oriented outer surface of the peg. Preferably the apparatus also includes another holding means, associated with another peg, for holding the ribbon on the vertically-oriented outer surface of the other peg.

Preferably the pegs are substantially cylindrical and the holding devices are partially-cylindrical plastic clips each of which snaps onto a respective peg to hold the ribbon between the clip and the outer surface of the peg. It is also preferred that the clips have hinge pins at lower ends of the clips, the pins being adapted to be inserted into holes formed in the pegs so that the clips are pivotally mounted on respective pegs.

The holes in the base of the bow-making apparatus are preferably arranged in two or more intersecting rows. Although the base may be rectangular and may have only a single row of holes, preferably the base is circular and has four to eight rows of holes. The number of pegs supplied with the base may be a dozen or more.

According to another aspect of the invention, there is provided a clip for holding a ribbon on a cylindrical outer surface of a peg, the clip including a clip body having a concave inner surface matched to a portion of the cylindrical outer surface of the peg, the clip body defining a part-cylindrical space, and the clip further including a pair of tabs, each of the tabs being substantially planar and extending outwardly from a respective edge of the clip body.

The bow-making apparatus of the present invention, which includes ribbon-holding clips associated with one or more of the pegs of the apparatus, makes it a simple matter for the individual using the apparatus to secure ribbon loops to the pegs when the winding of the ribbon loops is complete. In this way, the difficult concluding phases of the bow-making process are made much easier, particularly for amateur bow-makers.

Furthermore, the preferred embodiment of the invention, which has numerous rows of holes formed on a circular base, gives to the user of the apparatus many options in terms of styles and configurations of bows that may be constructed using the apparatus. Highly complex bows, which cannot be made with conventional bow-making jigs, become feasible when the apparatus of the present invention is employed.

DESCRIPTION OF PREFERRED EMBODIMENTS

Figure 1:
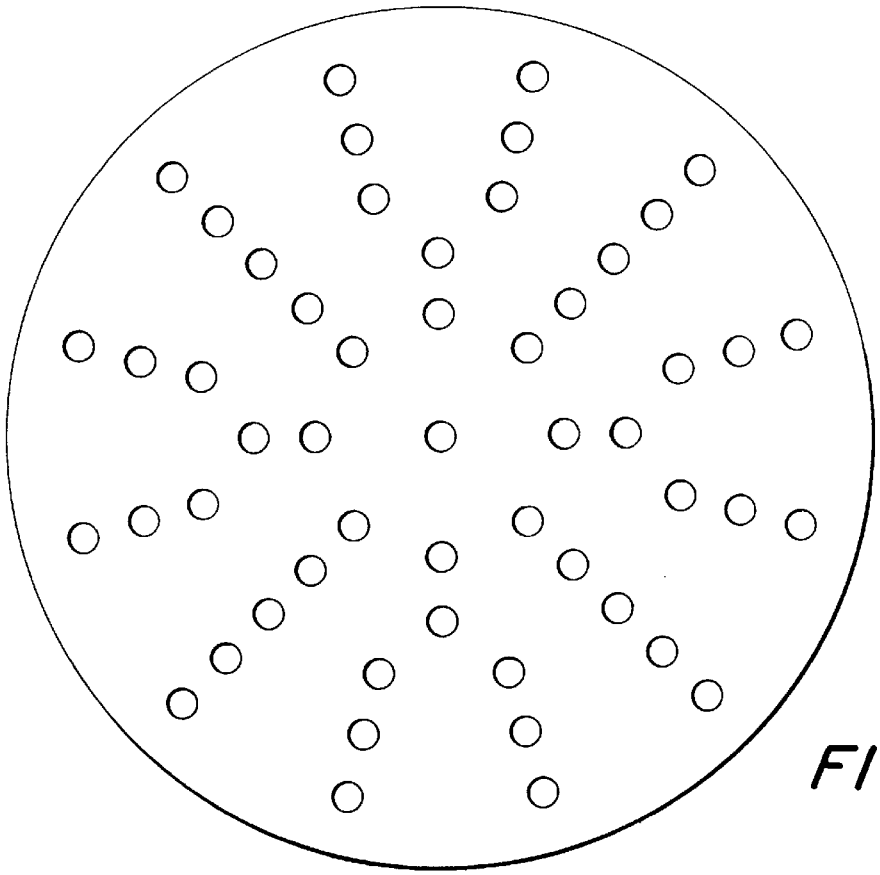
FIG. 1 is a plan view of the base portion of a bow-making jig provided in accordance with the invention.

A preferred embodiment of a bow-making jig provided in accordance with the invention will now be described, initially with reference to FIGS. 1 and 2. In FIG. 2, reference numeral 20 generally indicates a configuration of the bow-making jig provided in accordance with the invention. The jig 20 as shown in FIG. 2 is made up of a generally planar and circular base 22, cylindrical pegs 24 and clips 26, each of the clips being associated with a respective one of the pegs 24.

Figure 2:
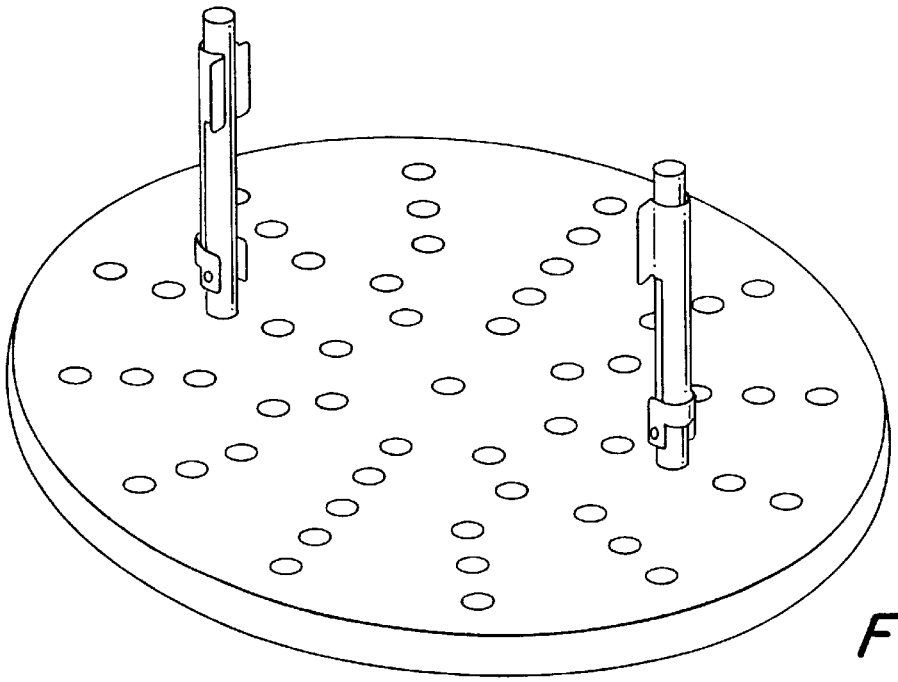
FIG. 2 is a perspective view of a bow-making jig provided according to the invention, and showing one configuration in which the jig may be employed.

As best seen from FIG. 1, a top surface 28 of the base 22 has numerous holes 30 formed therein. (For clarity of presentation, only a few of the holes 30 are explicitly labelled with a reference numeral.) In the embodiment of the base 22 shown in FIG. 1, the total number of holes is fifty-three. Each of the holes defines a substantially cylindrical space which is shaped and sized to receive one end of a peg 24 so that the peg 24 may be removably mounted in the base 22.

In the embodiment of the base 22 shown in FIG. 1, the holes are arranged in eight rows, including a row 32 consisting of eleven holes, a row 34 consisting of seven holes, a row 36 consisting of five holes, a row 38 consisting of seven holes, a row 40 consisting of eleven holes, a row 42 consisting of seven holes, a row 44 consisting of five holes, and a row 46 consisting of seven holes. It is to be noted that all of the eight rows 32, 34, 36, 38, 40, 42, 44 and 46 intersect at a central hole 30C which is common to all eight of the rows.

In the configuration of jig 20 shown in FIG. 2, two pegs 24 are installed, respectively, in the third and ninth holes of row 32. Each of the pegs 24 has mounted thereon a respective clip 26. As will be seen from subsequent discussion, the clips 26 are pivotally mounted on the pegs 24 so that the clips are movable between an upwardly-extending engaged position, which is shown in FIG. 2, and a horizontally-extending disengaged position which is shown, for example, in FIG. 7. The clips 26 are also arranged to face towards each other and towards the central hole 30C of the base 22. Accordingly, the clips 26 will be seen to be mounted on an outer surface of the respective peg 24, that is, on the surface of page 24 which faces away from the other peg. As will be understood from subsequent discussion, the pegs 24 are spaced apart from each other by a distance which substantially defines the width of the bow to be produced using the jig configuration shown in FIG. 2.

Figure 4:
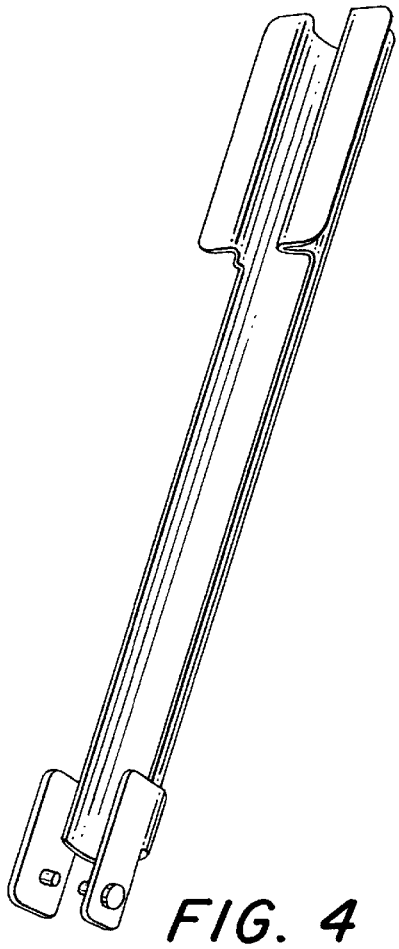
FIG. 4 is a perspective view of a clip which is included in the bow-making jig of FIG. 2 for the purpose of securing a ribbon to a respective peg.
Figure 5:
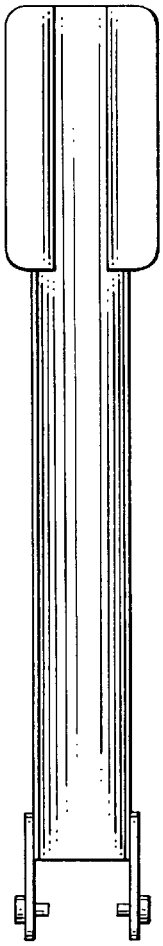
FIG. 5 is an elevational view of the clip of FIG. 4.

Details of the clips 26 and of the manner of mounting the clips to the pegs 24 will now be described, with reference to FIGS. 3–5.

Figure 3:
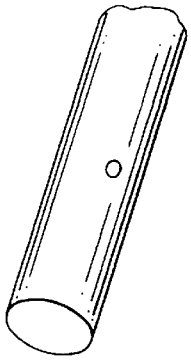
FIG. 3 is a partial perspective view of a bottom portion of a peg which is a component of the bow-making jig shown in FIG. 2.

FIG. 3 shows a perspective view of a portion of a peg 24, including a lower end 48 of the peg 24. The lower end 48 of the peg is intended to be inserted into one of the holes 30 of the base 22 in order to mount the peg 24 in the base. Near the lower end 48 two holes are formed in the peg extending inwardly from the curved main surface of the peg. The holes in the peg are aligned with each other and diametrically opposed to each other relative to a central axis of the peg 24, one such hole being visible in FIG. 3 and indicated by reference numeral 50. The holes in the peg 24 cooperate with pins on the clip 26 to provide the pivotal-mounting arrangement for the clip, as referred to above.

The clip 26 includes a generally part-cylindrical body 52 from which extensions 54 extend downwardly to support inwardly extending hinge-pins 56. The hinge-pins 56 together define a hinge-axis, and are shaped and sized, and spaced from each other, so as to be fittable into the above-described holes in a peg 24. When the hinge-pins are inserted in the holes in the peg, the axis defined by the hinge-pins coincides with an axis defined by the holes in the peg.

The clip body 52 has a concave inner surface 58 which matches the outer surface of the peg 24. At an upper end of the clip 26, opposite to the lower end at which the hinge-pins are located, are a pair of outwardly-extending tabs 60. Preferably the tabs are planar and lie in a plane common to the tabs, as best seen in FIG. 4.

Figure 6:
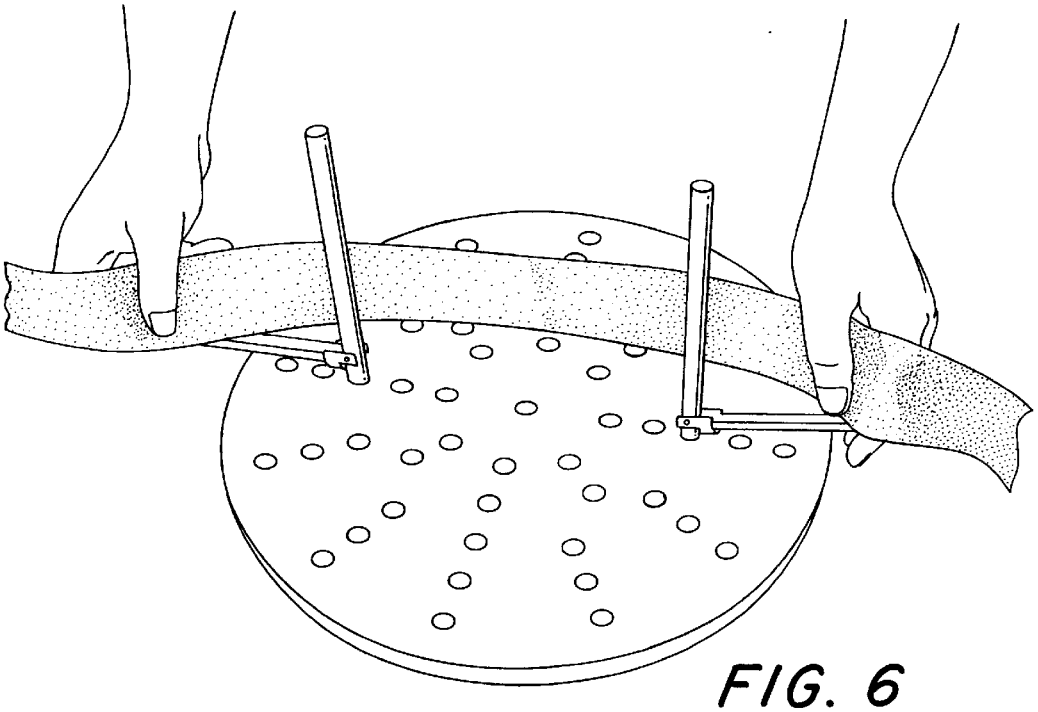
FIG. 6 is a perspective view of the jig of FIG. 2, indicating an initial stage in an operation for making a bow using the jig.
Figure 7:
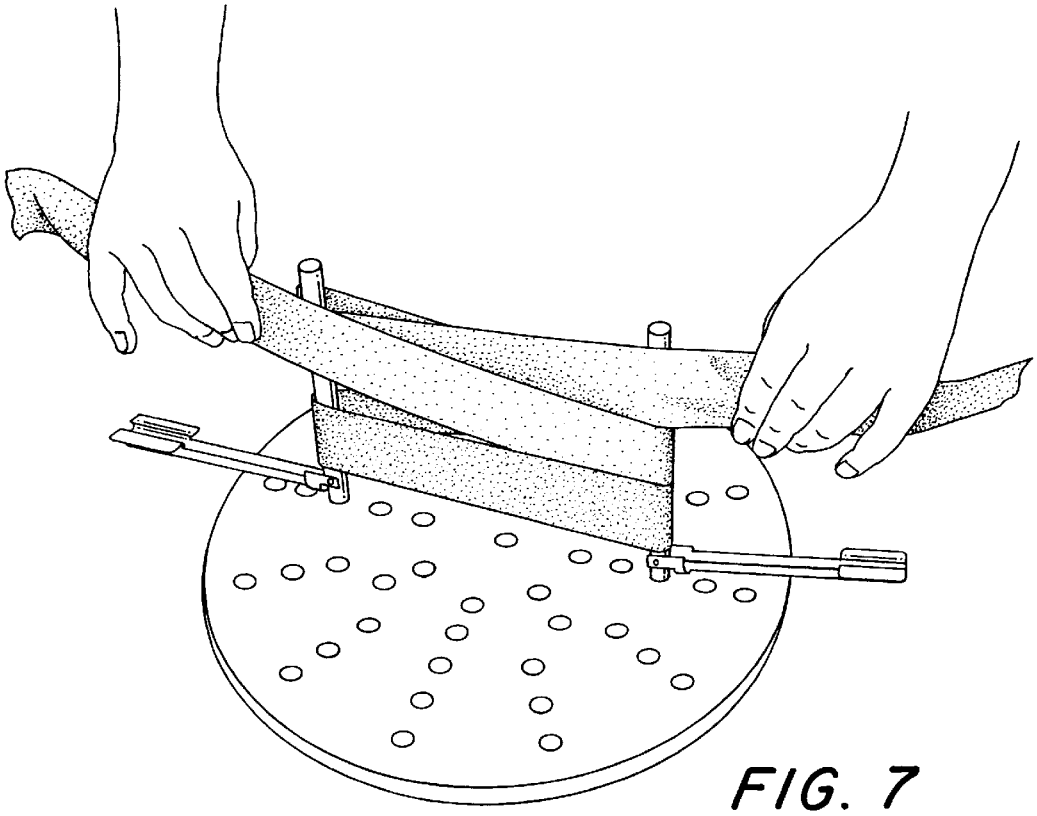
FIG. 7 is a view, similar to FIG. 6, but showing a later stage of the bow-making operation.
Figure 8:
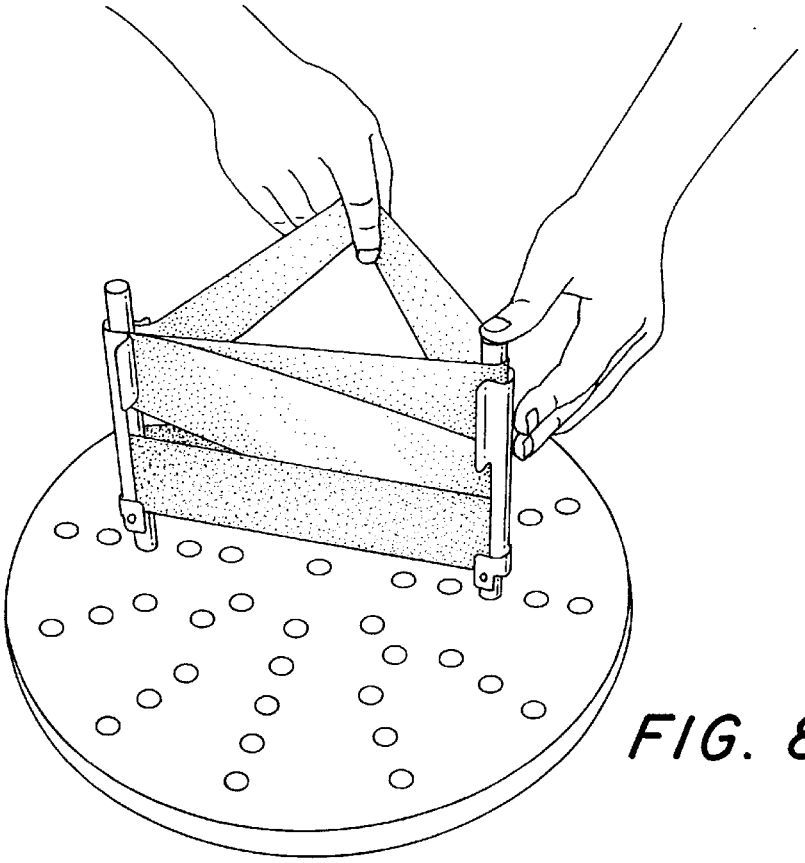
FIG. 8 is similar to FIGS. 6 and 7, but showing still a later stage of the bow-making operation.
Figure 9:
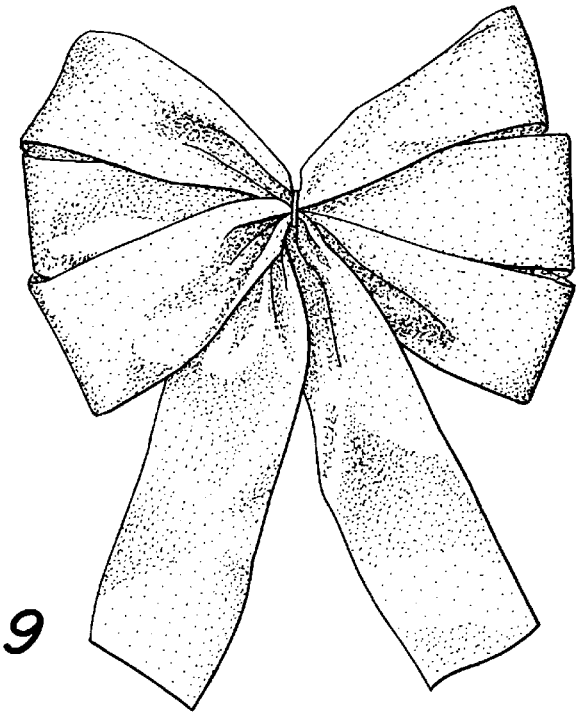
FIG. 9 is a plan view of a bow made by the operation illustrated in FIGS. 6–8.

FIGS. 6–8 illustrate an operation in which the jig, as configured in FIG. 2, is used to make the six-loop bow shown in FIG. 9. First, as illustrated in FIG. 6, the clips 26 are placed in their disengaged or horizontal position. It is to be appreciated that the tabs 60 of the clips 26 may be grasped or pushed by the user to aid in disengaging the clips from the respective pegs 24. The user then proceeds to wind a length of ribbon 62 around the pegs 24 until three loops are formed around each peg 24. When the winding of the ribbon is complete, the ends of the ribbon are held by one hand of the user, as shown in FIG. 8, and the user can then use the other hand to pivot the clips 26 into their engaged position, so that the loops of the ribbon are held between each clip 26 and the corresponding peg 24. With the ribbon thus secured to the pegs 24, both of the user's hands are free to apply a wire-tie or the like at a central portion of the wound ribbon. The bow loops are then removed from the pegs by, e.g. disengaging the clips from the ribbon loops and removing the pegs from the base. Then the loops can be shaped to produce the bow shown in FIG. 9.

Figure 10:
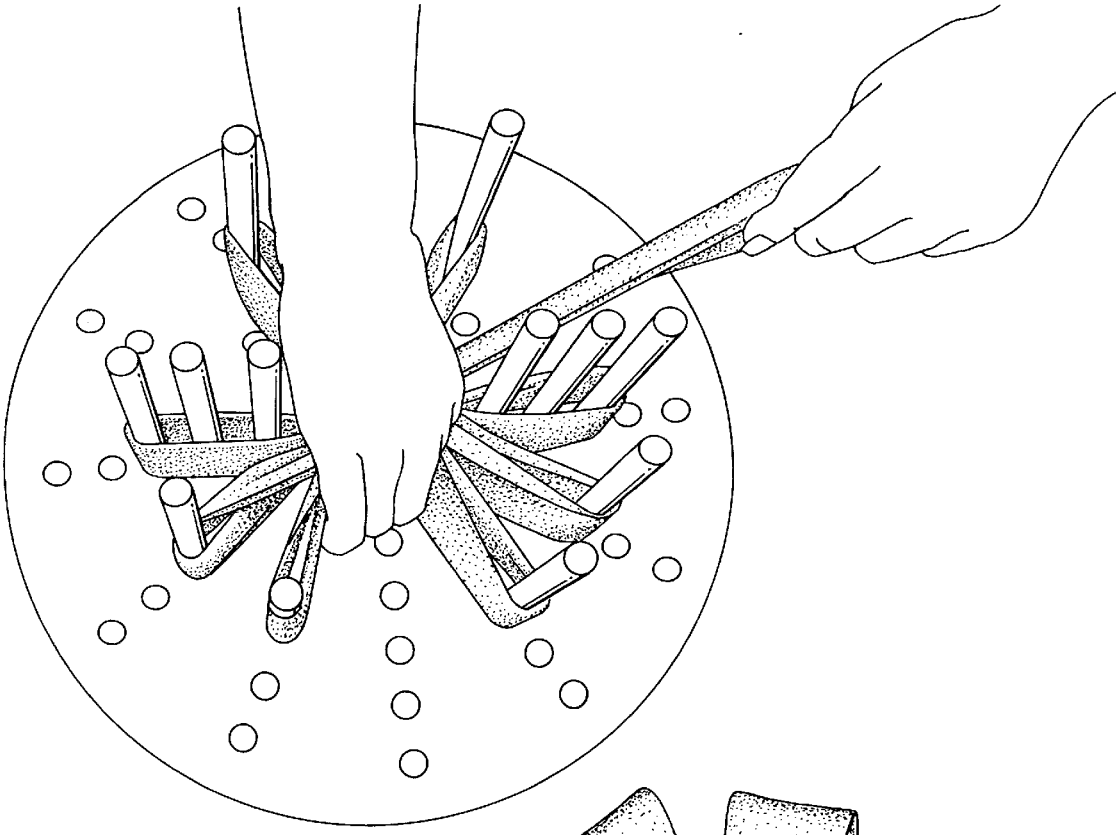
FIG. 10 is a top perspective view of the bow-making jig of FIG. 2 when configured for making a different type of bow, the drawing also illustrating an intermediate stage of an operation for making the bow.
Figure 11:
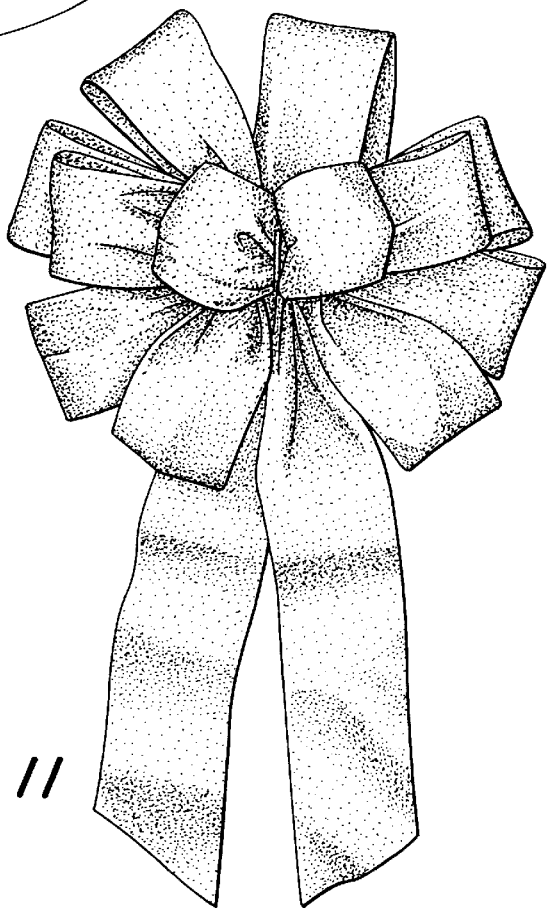
FIG. 11 is a plan view of a bow made by the operation illustrated in FIG. 10.

FIG. 10 illustrates a portion of another operation, in which the jig of the present invention is configured and employed to make a complicated bow which includes a dozen loops. In the jig configuration shown in FIG. 10, twelve pegs are mounted in respective holes in the base 22. FIG. 10 illustrates a point in the bow-making operation at which eight of the loops have been made, with four more loops remaining to be made, each of the remaining four loops corresponding to a respective one of the inner four pegs of a row of six pegs indicated at 64. Once all of the twelve loops have been formed, a wire-tie may be placed at the center of the bow to secure the loops, and then the loops may be shaped to achieve the final form of a "loopy" bow as shown in FIG. 11.

Although not visible in FIG. 10, a thirteenth peg may be installed in the central hole 30C (FIG. 1), to aid the user in changing the direction at which the ribbon is wound as the ribbon is looped from pegs in one row to a peg in another row. It is believed that the possible disadvantage of a thirteenth peg in the central hole in terms of obstructing the user's movements may be outweighed by the advantage gained by more easily guiding the ribbon to change direction around the central peg.

It will be noted that no clip 26 is employed in the jig configuration shown in FIG. 10, and, indeed, it is contemplated that all of the pegs shown in FIG. 10 may be "plain" in the sense that the pegs shown in FIG. 10 need not include the clip mounting holes 50 of which one is depicted in FIG. 3. Alternatively, some or all of the pegs shown in FIG. 10 may include the clip-mounting holes.

FIG. 10 is an example of how the circular shape of the jig base 22, and the large number of holes formed in the top surface thereof, make it possible, by using a suitable number of pegs, to form a complex bow. The bow shown in FIG. 11 is only one of many different types of bow that may be constructed. Correspondingly, the jig configurations shown in FIGS. 2 and 10 are examples of many different jig configurations that may be provided, simply by mounting a variable number of pegs at various locations in the jig base 22.

Although only two clips 26 are shown in the drawings, it should be understood that more than two clips may be deployed in a configuration of the jig, each pivotally mounted on a respective one of the pegs 24, it further being understood that each peg to which a clip is mounted includes the hinge-pin receiving holes referred to above in connection with FIG. 3. It is also contemplated to use a jig configuration having only a single one of the clips 26. Furthermore, it is contemplated to provide a jig configuration which includes both pegs on which clips are mounted, and pegs not having clips mounted thereon.

According to a preferred embodiment of the invention, both the base 22 and the pegs 24 are made of wood, and the clips 26 are of molded plastic. However, other materials may be used. For example, all of the components of the jig may be formed of plastic. Although the clips may conveniently be made of polypropylene, the clips may be made of other types of plastic, hard rubber, or metal or any other material which has a degree of natural elasticity. A preferred set of dimensions for the base is 14 inches in diameter by ¾ inch thick, and for the pegs, a height of 6 inches and a diameter of ½ inch. Of course, these dimensions are merely examples of many possible sizes.

The diameter of the holes 30 should be such as to snugly accommodate the pegs. The depth of the holes 30 may be about 9/16 inch.

The number and arrangement of the holes 30 in the base 22 may be changed in many ways without departing from the invention. Although it is preferred that the jig base have the round shape and numerous holes shown in the drawings, it also is contemplated to employ a rectangular jig, with only one row of holes, as in the bow-making apparatus of the above-referenced Ruiz patent. Thus the invention should be understood as including two rather independent aspects, of which one relates to the shape and hole-pattern of the base 22, and the other relates to the use of ribbon-securing clips associated with pegs installed in a base of any shape.

It should further be understood that the particular nature of the ribbon-securing mechanism is not essential to the latter aspect of the invention. Other mechanical arrangements for selectively securing the ribbon to the peg elements of a bow-making jig are also contemplated. For example, the pegs may be arranged to be hollow cylinders, open at least at one end, and the ribbon-securing mechanism may include a clip shaped like a bobby-pin or a paper clip which may be slidingly engaged with the wall of the hollow peg, to secure the ribbon loop at the outer surface of the peg wall.

It should also be recognized that clips shown in the drawings may be produced without the hinge-pins or without the tabs, or lacking both features. If hinge-pins are dispensed with, the clips would not be pivotally mountable on the pegs, but could simply be provided loose near the base of the jig and clipped onto the pegs at an appropriate point in the operation to secure the ribbon loops to the pegs.

The pegs 24 and holes 30 shown herein are substantially cylindrical, but pegs having a non-circular cross-section, such as square, rectangular, or other polygonal, may be used. Of course, the holes 30 should have a shape that is matched to the cross-section of the pegs.

The removably-mounted pegs shown herein function as upright members around which the ribbon is wound during a bow-making operation. However, instead of removably-mounted upright members, the jig of the present invention may be constructed with uprights which are fixedly mounted in the base and which have ribbon-holding means such as the clips described herein. For example, wooden pegs may be permanently mounted in holes in the base by means of glue or the like. Alternatively, the base and upright members may be integrally formed as a single body of molded plastic.

It should also be noted that the jig configuration of FIG. 10 can be used with pegs having clip mounting holes and with clips. Additionally, it should be understood that the use of one clip per loose ribbon end gives maximum benefit with respect to hand freedom, since it permits freeing of both hands. Use of additional clips then gives added control.

The bow-making jig apparatus disclosed herein is believed to make it possible for amateur bow-makers to achieve results in terms of quality of the bow produced comparable to those that are achieved by individuals who gain their livelihood by making bows. It is, however, to be expected that amateur bow-makers would not achieve the rate of production that professional-bow-makers are capable of. In any case, the bow-making apparatus of the present invention is highly advantageous in allowing the hobbyist to achieve high quality results.

Various changes to the foregoing apparatus may be introduced without departing from the invention. The particularly preferred apparatus described herein is thus intended in an illustrative and not limiting sense. The true spirit and scope of the invention are set forth in the following claims.

What is claimed is:

1. A bow-making apparatus, comprising:

a base, said base having a top surface with a plurality of holes formed in said top surface, each of said holes being shaped and sized to receive a respective peg;

a plurality of pegs, each of which is mounted in a respective one of said holes, each of said pegs having a vertically-oriented outer surface; and clip means, associated with one of said pegs, for securing a portion of a ribbon against the vertically-oriented outer surface of said one of said pegs.

2. A bow-making apparatus according to claim 1, further comprising a holding means, associated with another one of said pegs, for holding the ribbon on the vertically-oriented outer surface of said another peg.

3. A bow-making apparatus according to claim 1, wherein said clip means is a clip having a concave inner surface matched to a portion of said vertically-oriented outer surface of said one of said pegs.

4. A bow-making apparatus according to claim 3, wherein said vertically-oriented outer surface of said one of said pegs and said concave inner surface of said clip are both substantially cylindrical.

5. A bow-making apparatus according to claim 4, wherein said clip includes a pair of tabs which extend outwardly from a first end of said clip and a pair of hinge-pins which extend inwardly at a second end of said clip, said second end of said clip being opposite to said first end of said clip, said one of said pegs having a pair of holes formed therein, each of said hinge-pins of said clip being inserted into a respective one of said holes of said one of said pegs so that said clip is pivotally mounted on said one of said pegs.

6. A bow-making apparatus according to claim 1, wherein said plurality of holes formed in said top surface of said base includes at least four holes arranged in a linear row.

7. A bow-making apparatus according to claim 6, wherein said plurality of holes formed in said top surface of said base includes at least two rows of holes, each of said rows of holes including at least four holes.

8. A bow-making apparatus according to claim 7, wherein said two rows of holes intersect at a central point of said base.

9. A bow-making apparatus according to claim 8, wherein said plurality of holes formed in said top surface of said base includes eight rows of holes, each of said rows of holes including at least four holes.

10. A bow-making apparatus according to claim 9, wherein said plurality of holes formed in said top surface of said base consists of 53 holes.

11. A bow-making apparatus according to claim 8, wherein said base is substantially planar and circular.

12. A bow-making apparatus according to claim 1, wherein each of said pegs is substantially cylindrical and each of said holes defines a substantially cylindrical space.

13. A bow-making apparatus according to claim 12, wherein each of said pegs has a diameter of substantially ½ in. and a height of at least 6 inches.

14. A bow-making apparatus according to claim 1, wherein said pegs are made of wood.

15. A bow-making apparatus according to claim 1, wherein said base is made of wood.

16. A bow-making apparatus, comprising:

a base;

a pair of upright members which extend upwardly from the base and are spaced apart from each other to define a width dimension of a bow to be made using said apparatus, each of said upright members having an outer surface which faces away from the other upright member; and a pair of clip means, each associated with a respective one of said upright members, each of said clip means for securing a portion of a ribbon against the outer surface of the respective one of said upright members.

17. A bow-making apparatus according to claim 16, wherein each of said upright members is a peg inserted in a respective hole in an upper surface of said base.

18. A bow-making apparatus according to claim 17, wherein said means are clips pivotally mounted on said pegs.

* * * * *

UNITED STATES PATENT AND TRADEMARK OFFICE

CERTIFICATE OF CORRECTION

PATENT NO. : 6,131,778
DATED : October 17, 2000
INVENTOR(S) : Rafael Etztion

It is certified that error appears in the above-identified patent and that said Letters Patent is hereby corrected as shown below:

Title page,
Item [56], delete "Hoeycutt" and insert -- Honeycutt --.

Column 8,
Line 24, after "said" insert -- clip --.

Signed and Sealed this

Eighteenth Day of December, 2001

*Attest:*

*Attesting Officer*

JAMES E. ROGAN
*Director of the United States Patent and Trademark Office*